United States Patent [19]

Payne

[11] 3,960,124

[45] June 1, 1976

[54] POLLUTANT EMISSION CONTROL SYSTEM AND A COMBINED ELECTRIC SWITCH AND TEMPERATURE RESPONSIVE VALVE THEREOF

[75] Inventor: Frank Payne, Knoxville, Tenn.

[73] Assignee: Robertshaw Controls Company, Richmond, Va.

[22] Filed: Jan. 20, 1975

[21] Appl. No.: 542,633

[52] U.S. Cl. ..... 123/117 A; 137/554; 236/99 B; 337/401

[51] Int. Cl.[2] ..... F02P 5/04; F01P 5/14

[58] Field of Search ..... 123/117 A; 337/401; 137/554; 236/99 B

[56] References Cited

UNITED STATES PATENTS 3,680,533 8/1972 Soberski ..... 123/117 A 3,789,811 2/1974 Franz et al. ..... 123/117 A

*Primary Examiner*—Wendell E. Burns
*Assistant Examiner*—James W. Cranson, Jr.
*Attorney, Agent, or Firm*—O'Brien & Marks

[57] ABSTRACT

Improved pollutant emission control system and a combined electric switch and temperature responsive valve therefor as utilized in an internal combustion engine wherein a specially arranged electric switch and valve of the combined switch and valve is respectively connected to a catalytic converter of the engine exhaust system and to certain engine portions such as the engine spark device in order that the thermo-responsive power element of the combined switch and valve controls the operation of both the specially arranged electric switch and valve to minimize noxious pollutant emission from the engine exhaust system.

14 Claims, 12 Drawing Figures

POLLUTANT EMISSION CONTROL SYSTEM AND A COMBINED ELECTRIC SWITCH AND TEMPERATURE RESPONSIVE VALVE THEREOF

BACKGROUND OF THE INVENTION

1. Field of the Invention

This invention relates to an internal combustion engine and the pollutant emission control system therefor and in particular to the pollutant emission control system for an internal combustion engine and the combined electric switch and temperature responsive valve of the pollutant emission control system therefor.

2. Description of the Prior Art

In the past it has been conventional to provide various types of temperature responsive valves for controlling the emission of noxious pollutants from an internal combustion engine during its operation. A temperature responsive valve is connected to the coolant system of the internal combustion engine and to the spark advance control of the engine for minimizing the emission of pollutants from the engine during its operation at more than one temperature level. In addition, the temperature responsive valve has included an electric control switch combined therewith for also controlling another portion of the internal combustion engine such as the position of the carburetor butterfly valve thereof during its operation so as to further minimize the emission of pollutants from the engine.

The prior art, as exemplified by U.S. Pats. No. 3,212,337, No. 3,400,698, No. 3,680,533, No. 3,735,334 and No. 3,789,811 illustrates a variety of pollutant emission control devices or apparatus for controlling the emission of pollutants from an internal combustion engine during its use.

One of the problems associated with the prior pollutant emission control apparatus for an internal combustion engine is that they will not satisfactorily meet the requirements of pollution control laws in various countries that are or will become effective. While these air pollution control apparatus may have been satisfactory for the purpose for which they were designed they are not only incapable of meeting the current requirements of the pollution control laws but also are incapable of minimizing the emission of noxious air pollutants in the improved manner comtemplated by the pollutant emission control system of the present invention.

SUMMARY OF THE INVENTION

The present invention is summarized in a pollutant emission control system for an internal combustion engine and a combined electric switch and temperature responsive valve of the pollutant emission control system therefor wherein it includes an internal combustion engine, an exhaust system connected to the engine and including a catalytic converter means connected thereto, a gaseous fluid pump device mounted on the engine, a conduit means extending between and interconnected to said pump device and said converter means, said pump device for supplying a flow of gaseous fluid through said conduit means to said converter means, a solenoid-operated valve means connected to said conduit means for controlling the flow of gaseous fluid between said pump device and said converter means, a combined electric switch and temperature responsive valve means mounted on the engine and having a normally open electric switch means and a thermo-responsive power element means with controlling positions for controlling the operation of said combined switch and valve means, said combined switch and valve means including actuating means for interconnecting said electric switch means and said power element means; an electric circuit means including an electric power source, said electric switch means and said solenoid-operated valve means; said power element means for actuating said actuating means to effect closure of said electric switch means when said power element means is actuated from one of its controlling positions to another one of its controlling positions as the engine is being operated at a higher temperature level, and said solenoid-operated valve means including means upon closure of said electric switch means for shutting off the flow of gaseous fluid between said pump device and said converter means as the engine is being operated at the higher temperature level.

An object of the present invention is to provide a pollutant emission control system for an internal combustion engine that will further minimize the emission of noxious pollutants from the engine to the surrounding atmosphere during its use.

Another object of the present invention is to provide a pollutant emission control system for an internal combustion engine that includes a catalytic converter connected to the engine exhaust system for removing noxious pollutants from the engine exhaust flow.

Still another object of the present invention is to provide a combined electric switch and temperature responsive valve of the pollutant emission control system for an internal combustion engine that effectively prevents damage to the catalytic converter of the engine exhaust system.

This invention has another object in that the combined electric switch and temperature responsive valve for the pollutant emission control system of an internal combustion engine controls both the engine spark advance control device and the catalytic converter of the engine exhaust system during engine operation.

An object of the present invention is to provide a pollutant emission control system for an internal combustion engine including a combined electric switch and temperature responsive valve in which the continued and separate operations of both the electric switch and the valve of the combined switch and valve will not interfere with or otherwise impair one another throughout repeated use of the combined switch and valve of the pollutant emission control system of the present invention.

Another object of the present invention is to provide a pollutant emission control system for an internal combustion engine having a combined electric switch and temperature responsive valve of simplified and unitized construction that is less susceptible of malfunction or breakdown throughout its repeated use during engine operation.

Other objects and advantages of the present invention will become apparent from the following description taken in conjunction with the accompanying drawings.

DESCRIPTION OF THE PREFERRED EMBODIMENTS

Figure 1:
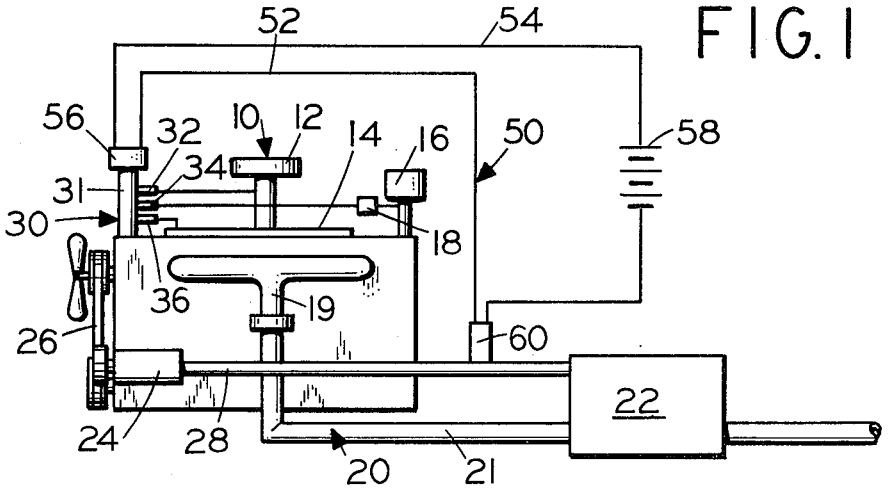
FIG. 1 is a diagramatic side elevational view of a pollutant emission control system for an internal combustion engine and embodying the present invention.

The present invention is embodied in a pollutant emission control system for an internal combustion engine 10 of appropriate design as illustrated in FIG. 1 the engine having a carburetor 12, an inlet manifold 14 connected to the carburetor 12, a distributor 16 with a spark advance control device 18, an exhaust system 20 with exhaust pipe 21 and exhaust manifold 19 and a catalytic converter 22 connected to the exhaust pipe 21 of system 20. A gaseous fluid or air pump device 24 is suitably mounted on one side of engine 10 at its front and is driven by the engine by way of a fan belt 26 that forms part of the engine fan belt and pulley system as shown in FIG. 1. A conduit 28 extends between and is interconnected to the catalytic converter 22 and pump device 24 for supplying a flow of gaseous fluid from the outlet of pump device 24 to the inlet of converter 22.

A combined electric switch and temperature responsive valve 30 of the pollutant emission control system of the present invention is connected to the engine 10 normally at the front and top thereof. The valve 31 of the combined valve 30 includes a plurality of three spaced ports 32, 34 and 36. Ports 32, 34 and 36 are individually connected by separate conduits to their respective carburetor 12, spark device 18 and inlet manifold 14 as depicted in FIG. 1. Depending upon the design of spark control 18 and/or the operating requirements of engine 10, ports 32 and 36, instead of being connected to the carburetor 12 and inlet manifold 14, may be connected, for example, to the inlet manifold 14 and the atmosphere surroundng engine 10 during its use.

Figure 2:
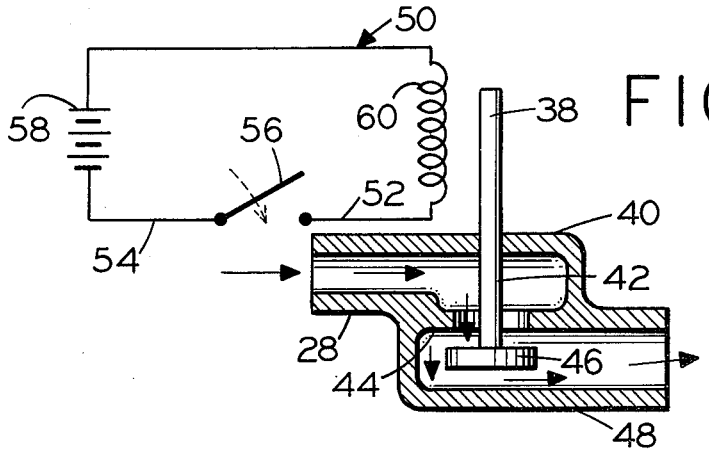
FIG. 2 is a diagramatic view of an electric control circuit in conjunction with an enlarged and partial sectional view of an electric controlled fluid inlet valve for a catalytic converter of the pollutant emission control system of the present invention.
Figure 3:
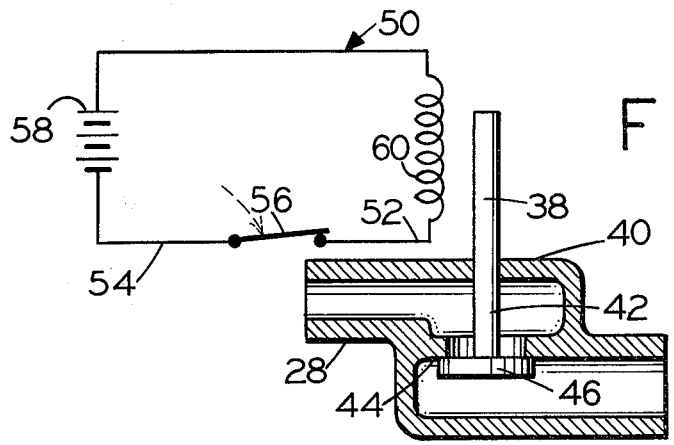
FIG. 3 is the combined diagramatic and enlarged partial sectional view of FIG. 2 and illustrates another operative position thereof.
Figure 4:
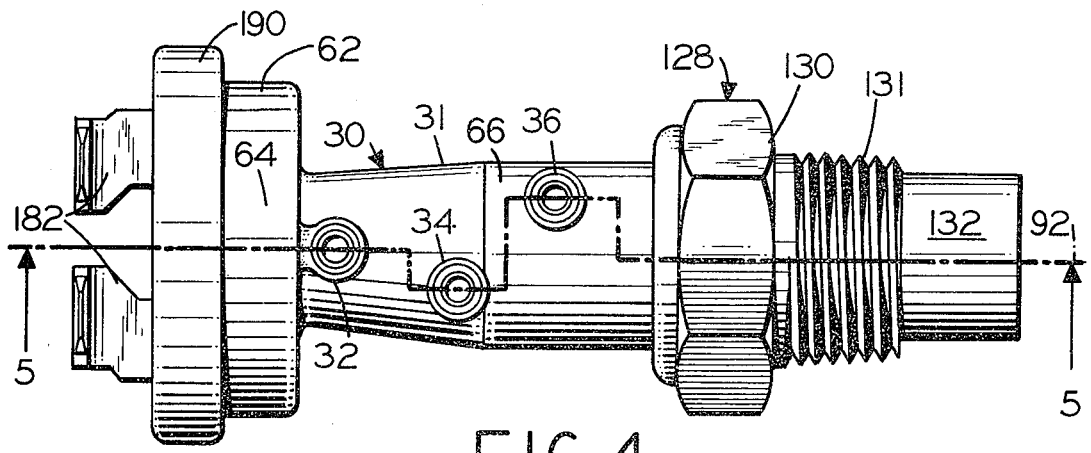
FIG. 4 is a side elevational view of a combined electric switch and temperature responsive valve of the pollutant emission control system of the present invention.

A poppet-type solenoid-operated valve 38 is connected to conduit 28 between the ends thereof as shown in FIGS. 1–3. An elbow 40 of conduit 28 includes an upper wall portion with an opening for slidably and sealably receiving the stem 42 of valve 38. An intermediate part of elbow 40 includes a valve seat 44 for seating the valve end 46 connected to stem 42 of valve 38. To facilitate assembly and/or disassembly of valve 38 from elbow 40 lower wall portion 48 of elbow 40 may include a removable cover element (not shown) having a diameter greater than the valve end 46 of valve 38.

An electric power circuit 50 has electric leads 52 and 54 series connected to normally open electric switch 56 of combined valve 30 and a solenoid 60 disposed adjacent and operatively associated with the stem 42 of valve 38. An electric storage battery 58 is series connected between intermediate portions of electric lead 54. When the electric switch 56 is in an open position, electric circuit 50 and solenoid 60 thereof are deenergized and valve 38 is disposed in an open condition for passing a flow of gaseous fluid from pump device 24 through conduit 28 to converter 22 during operation of engine 10 in the manner shown in FIGS. 1–2. Upon electric switch 56 of the combined valve 30 being in a closed position as depicted in FIG. 3, electric circuit 50 and solenoid 60 thereof are energized whereby the energized solenoid 60 moves valve 38 from an open to a closed position with its valve end 46 against seat 44 thereby stopping the flow of gaseous fluid from pump device 24 through conduit 28 to converter 22 during engine operation.

Figure 5:
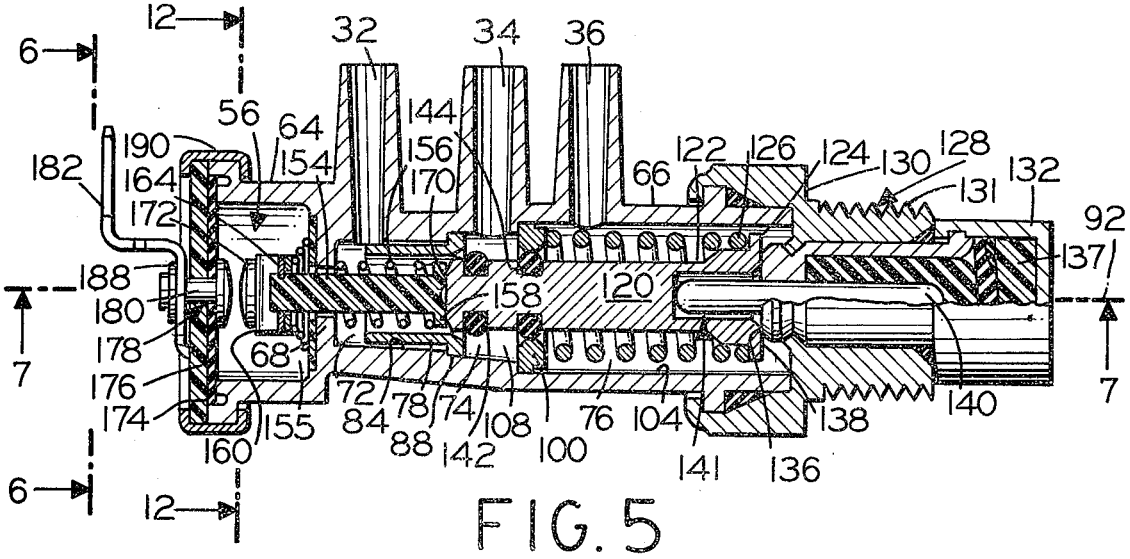
FIG. 5 is a longitudinal sectional view taken along line 5—5 of FIG. 4 and illustrates further details of the present invention.
Figure 6:
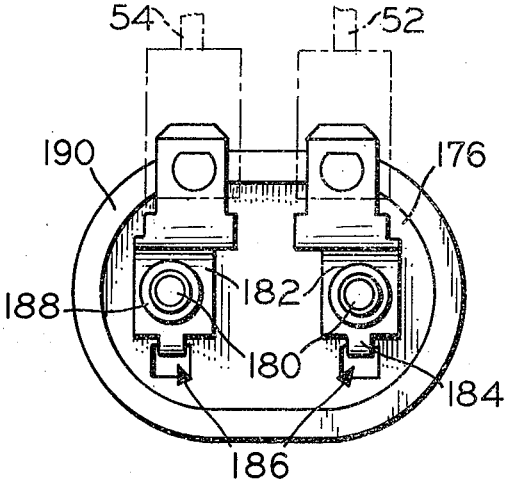
FIG. 6 is an end view taken along line 6—6 of FIG. 5 and with parts added in dotted and solid lines and other parts removed.
Figure 7:
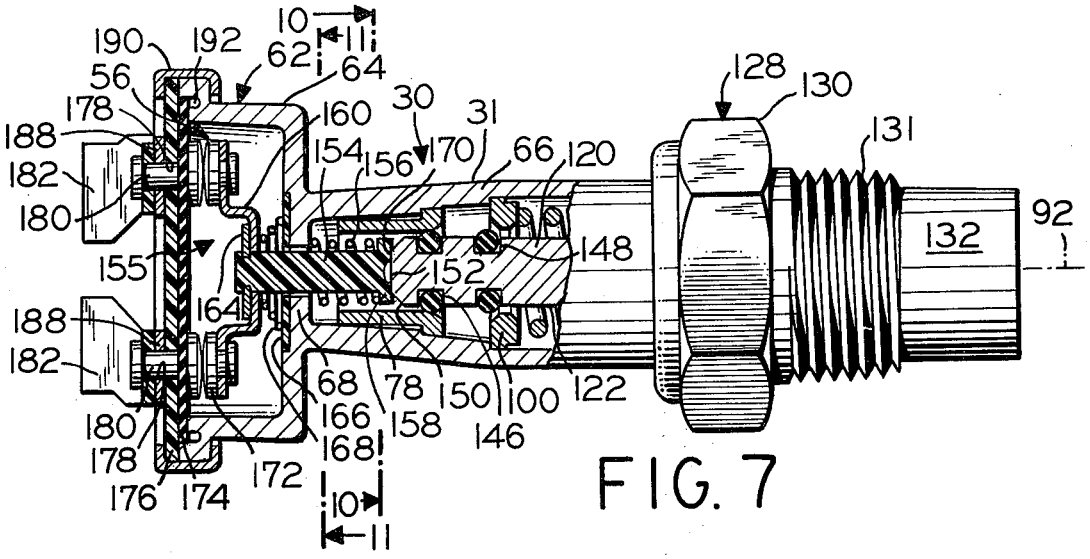
FIG. 7 is a longitudinal sectional view with parts added and other parts removed as taken along line 7—7 of FIG. 5 and illustrates another operative position of the present invention.
Figure 11:
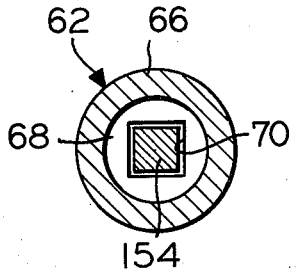
FIG. 11 is a sectional view with parts removed as taken along line 11—11 of FIG. 7.

As indicated in FIGS. 1 and 4–7 combined electric switch and temperature responsive valve 30 is made up of a generally hollow die cast metal tubular body 62 having an enlarged head end or portion 64 of elliptical shape in cross section with electric switch 56 therein and a reduced end 66 of generally circular-shape in cross section with valve 31 therein. An intermediate wall 68 has an aperture 70 of non-circular or square-shape in cross section and extends transversely of tubular body 62 between its ends 64 and 66 such that the apertured wall 68 serves to substantially or partially separate the electric switch end 64 of body 62 from the valve end 66 thereof as illustrated in FIGS. 5, 7 and 11. The aperture 70 of wall 68 forms an intermediate part of the hollow interior of body 62 and provides fluid intercommunication between the ends of the hollow interior of body 62. The hollow interior of body 62 at the valve end 66 includes a series of three chambers 72, 74 and 76 of progressively increased size in diametrical section between the inner and open outer portions of body 62 at its valve end 66 and are arranged in open intercommunication with the three spaced ports 32, 24 and 36 of body 62.

First valve seat 78 is made up of a cylindrical sleeve having an outer annular flanged end 80. An outer annular surface 82 at the non-flanged end of first seat 38 has a diameter somewhat smaller than the diameter of the intermediate portions of the frusto-conical surface 84 that defines the outer radial limits of chamber 72 and that diverges in an outward direction towards the open outer portion of body 62 at its valve end 66. The outer annular surface 86 at the flanged end of first seat 78 has a diameter slightly smaller than the diameter of the surface 88 that defines the outer radial limits of the inner portion of chamber 74. Because of the difference in diameter between the surfaces 82 and 84 of seat 78 and body 62 and between surfaces 86 and 88 of first seat 78 and body 62 first seat 78 is inserted through the outer open portion of body 62 at its valve end 66 and is forcefully driven until the shoulder 90 of seat 78 abuts the shoulder between surfaces 84 and 88 of body 62 thereby securing surface 86 of first seat 78 in tight frictional engagement with the surface 88 of body 62 and disposing first seat 78 in concentric alignment with the longitudinal axis 92 of body 62. When shoulder 90 of first seat 78 abuts the shoulder between surfaces 84 and 88 of body 62 the outer annular surface 82 of the non-flanged end of first seat 78 is spaced from frusto-conical surface 84 at the inner portion of body 62 at its valve end 66 as depicted in FIGS. 5 and 7.

Figure 8:
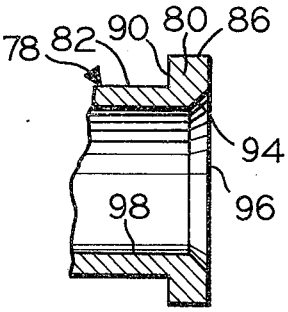
FIG. 8 is an enlarged longitudinal sectional view of a valve seat with portions broken away as illustrated in FIGS. 5 and 7.

An annular bevelled surface 94 of first seat 78 is interposed between and connected to radial end face 96 of the first seat 78 and the innermost annular surface 98 thereof in the manner shown in FIGS. 5 and 7–8. Bevelled surface 94 faces in a direction towards the outer open portion of body 62 at its valve end 66.

Second valve seat 100 of disc-shaped configuration has an outermost annular surface 102 that has a diameter somewhat smaller than the diameter of the interior annular surface 104 at the valve end 66 of body 62. Surface 104 defines the outer radial limits of chamber 76 adjacent the open outer portion at the valve end 66 of body 62. Second valve seat 100 is inserted through the open outer portion at the valve end 66 of body 62 and is forcefully driven through chamber 76 until the end face 106 of second seat 100 abuts the shoulder between the surfaces 104 and 108, with surface 108 defining the outer radial limits of chamber 74 adjacent the open outer portion of chamber 74 at the valve end 66 of body 62. At this time surfaces 104 and 102 of body 62 and second seat 100 are in tight frictional engagement thereby securing second seat 100 to body 62 at its valve end 66 in concentric alignment with the longitudinal axis 92 of body 62 and positioning second seat 100 in axially spaced relation to first seat 78.

Figure 9:
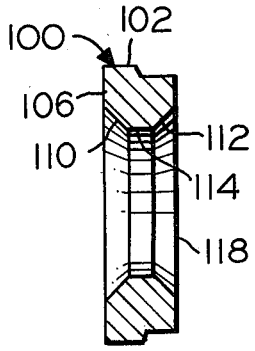
FIG. 9 is an enlarged cross sectional view of another valve seat in FIGS. 5 and 7.

Opposed annular bevelled surfaces 110 and 112 of second seat 100 are interconnected at their inner ends to an innermost interior annular surface 114 thereof. Annular surface 114 of second seat 100 has a diameter substantially corresponding to the diameter of surface 98 of first seat 78. Opposed radial end faces 106 and 118 of second seat 100 are connected to the outer ends of bevelled surfaces 110 and 112 as illustrated in FIGS. 5, 7 and 9. Bevelled surface 110 faces in a direction towards the inner portion of body 62 at its valve end 66 and bevelled surface 112 faces in a direction towards the open outer portion of body 62 at its valve end 66.

An actuating valve stem 120 is inserted through the open outer portion of body 62 at its valve end 66. The outer peripheral surface 122 of the inserted stem 120 at its inner end has a diameter smaller than the diameter of either one of the innermost annular surfaces 98 and 114 of the first and second seats 78 and 100. Outer end of stem 120 has a raised and stepped flange 124. A coil spring 126 is disposed about peripheral surface 122 of the stem 120 and extends between end face 118 of second seat 100 and the flange 124 of stem 120 as indicated in FIGS. 5 and 7. Spring 126 may be inserted through the open outer portion of body 62 at its valve end 66 before the insertion of stem 120 through the open outer portion thereof.

A thermo-responsive power element 128 includes a fitting 130 for effecting sealed connection to and closing off of the open outer portion of body 62 at its valve end 66 as shown in FIGS. 5 and 7. The capsuled end 132 of element 128 encloses a fusible wax substance 137 that has the characteristic of being in a non-expansible condition when solid at a lower temperature level and in an expanded condition when heated from a solid to a liquid state at a higher temperature level. Upon sealed connection of element 128 to body 62, stop surface 136 of element 128 abuts the outer end face 138 of stem 120. The threaded end 131 of fitting 130 is threadably connected to a suitable top portion at the front of engine 10 thereby mounting the combined switch and valve 30 of the present invention to the engine 10 and thereby disposing the capsuled end 132 of element 128 in direct contact with the coolant (not shown) of the engine coolant system (also not shown). The inner end of rod-type actuating piston 140 of element 128 is disposed in the bore 141 at the outer end of stem 120. Hence when element 128 is connected to body 62 as aforedescribed the bias of spring 126 urges end face 138 of stem 120 in abutment with the stop face 136 of element 128. Stem 120 has a length such that the inner end of stem 120 freely protrudes through and is spaced from the innermost surface 114 of second seat 100 and further partially protrudes into and is spaced from innermost surface 98 of first seat 78 adjacent its flanged end 80 as depicted in FIGS. 5 and 7.

The inner end of inserted stem 120 has first and second spaced annular grooves 142 and 144 disposed about the stem outer peripheral surface 122 and interposed between and spaced from first and second seats 78 and 100. O-rings 146 and 148 are arranged about and in first and second grooves 142 and 144 as shown in FIGS. 5 and 7. The outer peripheral portions of each o-ring 144,146 extend radially outward of stem surface 122 and have a diameter greater than the diameter of each one of the innermost surfaces 98 and 114 of first and second seats 78 and 100 whereby the outer peripheral portions of first o-ring 146 is arranged to sealingly engage surface 98 of first seat 78 and whereby the outer peripheral portions of second o-ring 148 is arranged to sealingly engage surface 114 of second seat 100 as indicated in FIGS. 5 and 7–9 respectively during operation of valve 31 of the combined switch and valve 30 of the present invention. The inner end of stem 120 includes a bevelled surface 150 facing in a direction towards the inner portion of intermediate wall 68 of body 62 at its valve end 66.

Figure 10:
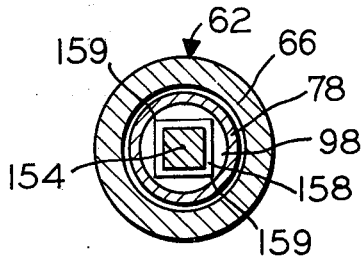
FIG. 10 is an enlarged sectional view with parts removed and other parts added as taken along line 10—10 of FIG. 7.

Electric switch 56 of the combined switch and valve 30 of the present invention includes an electric switch actuating stem 154 made up of an electric insulating material, such as nylon. Stem 154 has a non-circular or square-shape in cross section that is similar to but slightly smaller than the square cross sectional shape of aperture 70 in the intermediate wall 68 of body 62. Electric switch actuating stem 154 is inserted through the open outer portion of body 62 at its valve end 66 such that the outer end of stem 154 is freely inserted through the aperture 70 of intermediate wall 68 and protrudes into the outwardly facing cavity 155 at the enlarged electric switch end 64 of body 62 prior to the insertion of first and second seats 78 and 100, valve actuating stem 120 and coil spring 126 through the open outer portion of body 62 at its valve end 66 as aforedescribed. Cavity 155 forms the hollow interior of body 62 at its electric switch end 64. A coil spring 156 is disposed about stem 154 and is interposed between intermediate wall 68 and the flanged inner end 158 of stem 154 when the outer end of stem 154 is inserted through the aperture 70 of intermediate wall 68 as indicated in FIGS. 5, 7 and 10. Since stem 154 and aperture 70 of wall 68 are of non-circular shape in cross section stem 154 is non-rotatably mounted relative to intermediate wall 68 of body 62. Flanged end 158 of stem 154 has a non-circular or square-shape in transverse section in the manner illustrated in FIGS. 5, 7 and 10. Diagonally opposed corners 159 of the stem flanged end 158 have a distance therebetween slightly less than the diameter of the innermost annular surface 98 of first seat 78. Accordingly the diagonally opposed corners 159 of the flanged end 158 of stem 154 slidably engage diametrically opposed surface portions of surface 98 of first seat 78 during use of the combined switch and valve 30 of the present invention.

An electric switch bridging element strip 160 has a hat-shaped configuration with the intermediate portion of bridging strip 160 having a centrally located aperture 162. Aperture 162 of bridging strip 160 has a non-circular or square-shape in cross section similar to but larger than the non-circular cross sectional shape of stem 154 whereby the outer end of stem 154 is freely inserted through the aperture 162 of bridging strip 160 such that the bridging strip 160 is slidably but non-rotatably mounted on the outer end of stem 154. A suitable lock washer 164 is inserted in the annular groove at the outer end of stem 154 for retaining bridging strip 160 on stem 154.

An apertured sheet of electric insulating material 166 such as a suitable grade of laminated plastic sheet material is mounted in the outward facing recessed portion of intermediate wall 68 of body 62 at the electric switch end 64 thereof and is disposed about and spaced from stem 154 in the manner shown in FIGS. 5 and 7. A metal coil spring 168 is interposed between and connected to the electric insulating sheet 166 and the intermediate portion of bridging strip 160. Spring 168 serves to bias the bridging strip 160 in a direction towards the outer portion at the electric switch end 64 of body 62 so that the intermediate portion of strip 160 is urged into contact with lock washer 164. With spring 168 urging bridging strip 160 into contact with lock washer 164, the aforementioned spring 156 urges the inner end face 170 of stem 154 into abutting engagement with the inner end face 152 of valve actuating stem 120 throughout use of the combined switch and valve 30 of the present invention. Spring 126 has a greater strength than spring 156 and spring 156 has a greater strength than spring 168 whereby the springs 126, 156 and 168 cooperate to maintain abutting engagement between the end faces 152 and 170 of stems 120 and 154 and between the end faces 136 and 138 of power element 128 and stem 120 so that stems 120 and 154 act in effect as a single unbroken link between the ends 64 and 66 of the combined switch and valve 30 of the present invention throughout its use.

Figure 12:
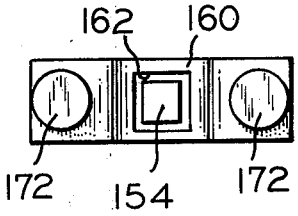
FIG. 12 is an end elevational view with parts removed as taken along line 12—12 of FIG. 5.

Each one of a pair of laterally spaced contact rivets 172,172 is affixed to its respective outer apertured end portion of strip 160 as indicated in FIGS. 5, 7 and 12. A sealing gasket 174 of elliptical shape and usually made up of a sheet of resilient and compressible natural or synthetic rubber material is disposed on the back side of a thicker sheet 176 having an elliptical shape corresponding to the elliptical shape of rubber sheet 174. Sheet 176 having electric insulating characteristics is made up of a suitable grade of laminated plastic material. Sheets 174 and 176 have spaced and aligned apertures that form spaced common apertures 178 with each one of the common apertures 178 being axially aligned with the associated aperture of its respective end portion of strip 160 when sheets 174 and 176 are attached to the outer portion at the electric switch end 64 of body 62. Each one of a pair of electric contact rivets 180 is disposed in its respective common aperture 178, extends between sheets 174 and 176 and is affixed thereto as shown in FIGS. 5–7.

In affixing a rivet 180 to sheets 174 and 176 the outer end of the rivet on the outer side of sheet 176 has a z-shaped electric terminal clip 182 connected thereto. The outer free end of each clip 182 is series connected to its associated snap-on terminal end of its respective electric lead 52 or 54 of electric circuit 50 as indicated by dotted lines in FIG. 6. The inner end of a clip 182 includes a lug portion 184 seated in a recessed portion 186 on the outer side of sheet 176 for further securing clip 182 to sheet 176. A brass washer 188 is interposed between the outer end of each rivet 180 and the inner end of each clip 182 in the manner illustrated in FIGS. 5–7.

A metal flange 190 of elliptical shape is disposed about the outer flanged portion at the electric switch end 64 of body 62. The outer end of the flange 190 is deformed about the outer periphery of sheet 176 so as to clampingly secure sheets 174 and 176 to the outer portion at the electric switch end 64 of body 62 and at the same time sealingly engage the outer periphery of sheet 174 to the outer portion at the electric switch end 64 of body 62 thereby closing off and covering the electric switch end 64 of body 62 as illustrated in FIGS. 5 and 7. The outer portion at the electric switch end 64 of body 62 includes an elliptical groove 192 for effecting further seating and sealing of the outer periphery of sheet 174 when the outer end of flange 190 is deformed as aforedescribed.

By reason of the electric switch end 64 of body 62 being sealingly closed and by reason of power element 128 being sealingly connected to the valve end 66 of body 62 as aforedescribed, no fluid leakage occurs from the combined switch and valve 30 of the present invention during its use. At the same time opposed electric contact surfaces of the opposed and aligned spaced pair of electric contact rivets 172,172 and 180,180 in being enclosed in the covered cavity 155 at the electric switch end 64 of body 62 are substantially free of foreign debris and/or other contaminants that might interfere with the operation of the opposed pairs of contact rivets 172,172 and 180,180 throughout operation of the pollutant emission control system of the present invention.

Converter 22 includes an appropriate substance or catalyst for accelerating the reaction of incompletely burned gaseous products that form part of the admixture of air and completely and incompletely burned gaseous products of the exhaust flow of engine 10 exhausting through the outlet of pipe 21 of the engine exhaust system 20 during engine operation. In the absence of converter 22, the incompletely burned gaseous products that make up part of the admixture of the exhaust flow of engine 10 are noxious especially to humans. In order for the catalyst of converter 22 to be effective, the converter must receive a relatively pure supply of a gaseous medium usually oxygen as supplied by the air pump device 24 through conduit 28 as aforedescribed. It has been found that the catalyst of converter 22 becomes injured when the engine 10 is operated above a certain temperature level.

Accordingly if the temperature of the coolant in the coolant system of engine 10 is below about 225°F, the wax 137 of the power element 128 of the combined switch and valve 30 remains in the one controlling position of FIG. 5 and therefore electic switch 56 remains open with valve 38 remaining open and pump 24 supplying a flow of air through conduit 28 to converter 22 for its operation and reduction of noxious pollutants from the engine exhaust flow during engine operation. On the other hand if the coolant of the coolant system of engine 10 with the engine operating is above about 225°F, the wax 137 of power element 128 becomes melted and expands thereby moving piston 140 to the left in FIG. 7 and power element 128 to another one of its controlling positons. At the same time valve and electric switch actuating stems 120 and 154 are moved to the left in FIG. 7 thereby closing electric switch 56 and energizing electric circuit 50. Energization of circuit 50 energizes solenoid 60 causing movement of valve to a closed position and shutting off the flow of air from pump 24 through conduit 28 to converter 22 thereby preventing damage to converter 22 without interfering with the continued operation of engine 10. It is noted here that when valve 38 is closed pump 24 may include a relief valve (not shown) for releasing the air flow until valve 38 is reopened.

When engine 10 is operating at a lower temperature level below about 225°F especially at idle speeds, power element 128 is in the one controlling position as shown in FIG. 5. At this time second O-ring 148 sealingly engages surface 144 of second seat thereby closing off intercommunication between spaced ports 34 and 36 while first o-ring 146 is spaced from beveled surface 94 of first seat 78 thereby establishing flow intercommunication between ports 32 and 34 through the passageway between the spaced beveled surfaces 94 and 150 of first seat 78 and valve stem 120. The spaced beveled surfaces 94 and 150 facilitate fluid flow through the passageway therebetween. With the spaced ports 32 and 34 being in open intercommunication, spark advance device 18 is connected to the vacuum of carburetor 12 thereby effecting operation of engine 10 at an idle speed and with a retarded spark condition. As aforementioned with the power element 128 in the one controlling position in FIG. 5, electric switch 56 is open, thereby enabling the operation of converter 22 for effecting removal of noxious pollutants from the engine exhaust flow.

Upon engine 10 being operated at a higher temperature level above about 225°F such as for example as the result of the engine overheating when engine 10 is run with a retarded spark at idle speeds, the wax 137 of power element 128 is melted and expanded thereby actuating the power element 128 from its one controlling position in FIG. 5 to another one of its controlling positions as indicated in FIG. 7. At this time first O-ring 146 sealingly engages surface 98 of first seat 78 thereby closing off communication between ports 32 and 34 while second o-ring 148 is spaced from beveled surface 110 of second seat 100 thereby establishing flow intercommunication between spaced ports 34 and 36 through the passageway between surfaces 110, 114 and 112 of second seat 100 and opposed annular portions of the outer peripheral surface 122 of stem 120. The beveled surfaces 110 and 112 of second seat 100 facilitate fluid flow through the passageway between second seat surfaces 110, 114 and 112 and opposed portions of stem surface 122. By reason of ports 34 and 36 being in open communication the spark advance device 18 of engine 10 is in direct communication with the inlet manifold 14 thereby causing the advancement of the engine spark so as to operate engine 10 at a higher speed to cool the engine; and, power element 128 in the other one of its controlling positions as shown in FIG. 7, electric switch 56 is closed and therefore converter 22 ceases to operate as set forth above.

Even if stem 154 has excessive movement to the left in FIG. 7 because of greater expansion of wax 140 due to overheating of engine 10 during its use the slidable movement between bridging portion 160 and electric switch actuating stem 154 will prevent excessive pressure contact between the opposed pairs of contact rivets 172,172 and 180,180. When slidable movement between bridging portion 160 and electric switch actuating stem 154 occurs, as the stem 154 has excessive movement to the left in FIG. 7, spring 168 will assure proper contact pressure between opposed pairs of contacts 172,172 and 180,180. Inasmuch as the diagonally opposed corners 159 of electric switch stem 154 are in slidable engagement with surface 98 of first seat 78, electric switch stem 154 is maintained in axial alignment with the longitudinal axis 92 of body 62 throughout use of the combined switch and valve 30 of the present invention. Because stem 154 has a non-circular shape in non-circular aperture 70 of wall 68 and the aperture 162 of bridging portion 160 also has a non-circular shape, the pair of bridging contacts 172 maintain proper alignment with the opposed pair of contacts 180,180 throughout repeated use of the combined switch and valve 30 of the pollutant emission control system of the present invention.

Since the present invention is subject to many modifications, variations and changes in detail, it is intended that all matter contained in the foregoing description or shown in the accompanying drawings shall be interpreted as illustrative and not in a limiting sense.

What is claimed is:

1. A combined electric switch and temperature responsive valve for a pollutant emission control system of an internal combustion engine, said combined switch and valve comprising a tubular body having a valve end and an electric switch end and a generally hollow interior between the ends of said body, an intermediate wall means interposed between the ends of said body for partially dividing the hollow interior between the ends of said body, said intermediate wall means having an aperture that forms part of the hollow interior and that is in communication with the hollow interior between the ends of said body, an internal combustion engine, a thermo-responsive power element means connected to the valve end of said body and the internal combustion engine, said power element means having more than one controlling position for controlling the operation of said combined switch and valve during operation of the internal combustion engine, an electic switch and valve actuating means connected to said power element means and extending in the hollow interior of said body from its valve end through the aperture of said wall means into its electric switch end, said electric switch and valve actuating means having an outer electric switch end portion at the electric switch end of said body, the electric switch end of said body having spaced electric contact terminal means and an electric bridging means for electrically interconnecting said spaced electric contact terminal means, said bridging means being slidably mounted on the outer electric switch end portion of said electric switch and valve actuating means at the electric switch end of said body, means on the outer electric switch end portion of said electric switch and valve actuating means for retaining said bridging means on the outer electric switch end portion, and spring means interposed between said bridging means and said intermediate wall means and urging said bridging means into engagement with said spaced electric contact terminal means when said electric switch and valve actuating means is moved in a direction towards the electric switch end of said body upon actuation of said thermo-responsive power element means from one controlling position to another as said combined switch and valve is operated during operation of the internal combustion engine.

2. A combined electric switch and temperature responsive valve as set forth in claim 1 wherein said spring means is a coil spring about the outer electric switch end portion of said electric switch and valve actuating means.

3. A combined electric switch and temperature responsive valve as set forth in claim 1 wherein other spring means are disposed in the interior of said body between the intermediate wall means and the valve end for urging said electric switch and valve actuating means into engagement with said power element means.

4. A combined electric switch and temperature responsive valve as set forth in claim 1 wherein an electric insulator means is interposed between said intermediate wall means and said spring means for electrically insulating said spring means and said bridging means from said intermediate wall means.

5. A combined electric switch and temperature responsive valve as set forth in claim 1 wherein said body has an enlarged head portion surrounding the hollow interior at the electric switch end, and wherein said bridging means is disposed in spaced relation to said head portion.

6. A combined electric switch and temperature responsive valve as set forth in claim 5 wherein said head portion has an elliptical shape in cross section.

7. A combined electric switch and temperature responsive valve as set forth in claim 5 wherein a mounting means of electric insulative material mounts said spaced electric contact terminal means in spaced relation to each other, and wherein an attaching means secures said mounting means to said head portion and holds said spaced electric contact terminal means in spaced relation to said bridging means when said thermo-responsive power element means is in one of its controlling positions during operation of the internal combustion engine.

8. A combined electric switch and temperature responsive valve as set forth in claim 7 wherein a gasket means is interposed between said mounting means and said head portion for sealably connecting said mounting means to said head portion of said body at the electric switch end.

9. A combined electric switch and temperature responsive valve as set forth in claim 1 wherein said electric switch and valve actuating means includes an electric switch actuating means having the outer electric switch end portion, wherein said electric switch actuating means has a non-circular shape in cross section, wherein the aperture of said intermediate wall means has a non-circular shape in cross section somewhat larger than the non-circular shape of said electric switch actuating means, wherein said bridging means has an opening to slidably receive the outer electric switch end portion of said electric switch actuating means, and wherein the opening of said bridging means has a non-circular shape in cross section slightly larger than the non-circular shape of said electric switch actuating means.

10. A combined electric switch and temperature responsive valve as set forth in claim 1 wherein the valve end of said body includes a plurality of spaced ports, each one of the ports of said plurality being in communication through the hollow interior of said body with the other of the ports thereof.

11. A combined electric switch and temperature responsive valve as set forth in claim 10 wherein said electric switch and valve actuating means includes a valve actuating means, wherein said valve actuating means includes seat means, and wherein said body in its interior at the valve end thereof includes seating means arranged to cooperate with said seat means during operation of said combined switch and valve as the engine is being operated.

12. A combined electric switch and valve means as set forth in claim 11 wherein said electric switch and valve actuating means includes electric switch actuatng means, wherein said electric switch actuating means has means disposed in slidable engagement with said seating means.

13. A combined electric switch and temperature responsive valve as set forth in claim 10 wherein the plurality of spaced ports is comprised of three spaced ports.

14. A combined electric switch and temperature responsive valve as set forth in claim 13 wherein said electric switch and valve actuating means is comprised of valve actuating means, wherein first and second spaced seating means are disposed in the interior of said body at its valve end, said first seating means being interposed between one and another ports of said plurality, and said second seating means being interposed between the other port and a third port of said plurality, wherein first and second spaced seating means are disposed on said valve actuating means and wherein each one of said first and second seating means cooperate with its respective first and second seating means during operation of said combined switch and valve.

* * * * *